US012434935B2

(12) United States Patent
Takahashi et al.

(10) Patent No.: US 12,434,935 B2
(45) Date of Patent: Oct. 7, 2025

(54) CONVEYANCE DEVICE AND IMAGE FORMING APPARATUS

(71) Applicant: FUJIFILM Business Innovation Corp., Tokyo (JP)

(72) Inventors: Kohei Takahashi, Kanagawa (JP); Hiroyuki Tanaka, Kanagawa (JP); Hiroyuki Momiyama, Kanagawa (JP); Tomoya Kosuge, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 471 days.

(21) Appl. No.: 17/967,902

(22) Filed: Oct. 18, 2022

(65) Prior Publication Data

US 2023/0118502 A1 Apr. 20, 2023

(30) Foreign Application Priority Data

Oct. 20, 2021 (JP) ..... 2021-171826

(51) Int. Cl.
*B65H 29/60* (2006.01)
*B65H 5/36* (2006.01)

(52) U.S. Cl.
CPC ..... *B65H 29/60* (2013.01); *B65H 5/36* (2013.01); *B65H 2801/06* (2013.01)

(58) Field of Classification Search
CPC ..... B65H 29/60; B65H 5/36; B65H 2801/06
See application file for complete search history.

(56) References Cited

U.S. PATENT DOCUMENTS 4,416,450 A * 11/1983 van Wijngaarden ... B07C 3/065 198/367
5,028,046 A * 7/1991 Kuwahara ..... G03G 15/6573 271/301
8,628,081 B2 * 1/2014 Michels ..... B65H 29/58 902/15

FOREIGN PATENT DOCUMENTS

JP H04308147 10/1992
JP 2007197105 8/2007

OTHER PUBLICATIONS

"Notice of Reasons for Refusal of Japan Counterpart Application", issued on Apr. 22, 2025, with English translation thereof, p. 1-p. 6.

* cited by examiner

*Primary Examiner* — Thomas A Morrison
(74) *Attorney, Agent, or Firm* — JCIPRNET

(57) ABSTRACT

A conveyance device includes: a conveyance unit that conveys a material to be conveyed; a guide unit that guides the material to be conveyed, the guide unit being movable between a first position at which a first conveyance path is formed and a second position at which a second conveyance path is formed; a driving unit that drives the conveyance unit and the guide unit; a restriction unit that comes into contact with the guide unit moving in a moving direction from the second position to the first position at the first position by a driving force of the driving unit to restrict the movement of the guide unit in the moving direction; and a blocking unit that blocks transmission of the driving force of the driving unit to the guide unit when a moving load greater than or equal to a predetermined load acts on the guide unit moving in the moving direction.

7 Claims, 11 Drawing Sheets

CONVEYANCE DEVICE AND IMAGE FORMING APPARATUS

CROSS-REFERENCE TO RELATED APPLICATIONS

This application is based on and claims priority under 35 USC 119 from Japanese Patent Application No. 2021-171826 filed Oct. 20, 2021.

BACKGROUND

(i) Technical Field

The present invention relates to a conveyance device and an image forming apparatus.

(ii) Related Art

JP2007-197105A discloses an image forming apparatus that includes an image forming apparatus body, a main conveyance path which is provided within the image forming apparatus body and through which a sheet on which an image is formed, a discharge path which is connected to the main conveyance path and discharge a sheet, a switchback conveyance path which is connected to an upper side of the main conveyance path and switches back the sheet, and a re-supply path which is provided within the image forming apparatus body and which is connected to the switchback conveyance path, and re-supplies the switchback sheet.

For a conveyance device that includes a conveyance unit that conveys a material to be conveyed and a guide body that guides the material to be conveyed, the guide unit being movable between a first position at which a first conveyance path is formed and a second position at which a second conveyance path is formed, when a size of the conveyance device increases in size when a driving unit such as a solenoid that moves the guide unit is provided separately from a driving unit that drives the conveyance member.

SUMMARY

Aspects of non-limiting embodiments of the present disclosure relate to a conveyance device that suppresses upsizing of a conveyance device as compared with a case where a driving unit that moves a guide unit is provided separately from a driving unit that drives a conveyance unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a conveyance device including a conveyance unit that conveys a material to be conveyed, a guide unit that guides the material to be conveyed, the guide unit being movable between a first position at which a first conveyance path is formed and a second position at which a second conveyance path is formed, a driving unit that drives the conveyance unit and the guide unit, a restriction unit that comes into contact with the guide unit moving in a moving direction from the second position to the first position at the first position by a driving force of the driving unit to restrict the movement of the guide unit in the moving direction, and a blocking unit that blocks transmission of the driving force of the driving unit to the guide unit when a moving load greater than or equal to a predetermined load acts on the guide unit moving in the moving direction.

DETAILED DESCRIPTION

Hereinafter, an example of an embodiment according to the present invention will be described with reference to the drawings.

(Image Forming Apparatus 10)

Figure 1:
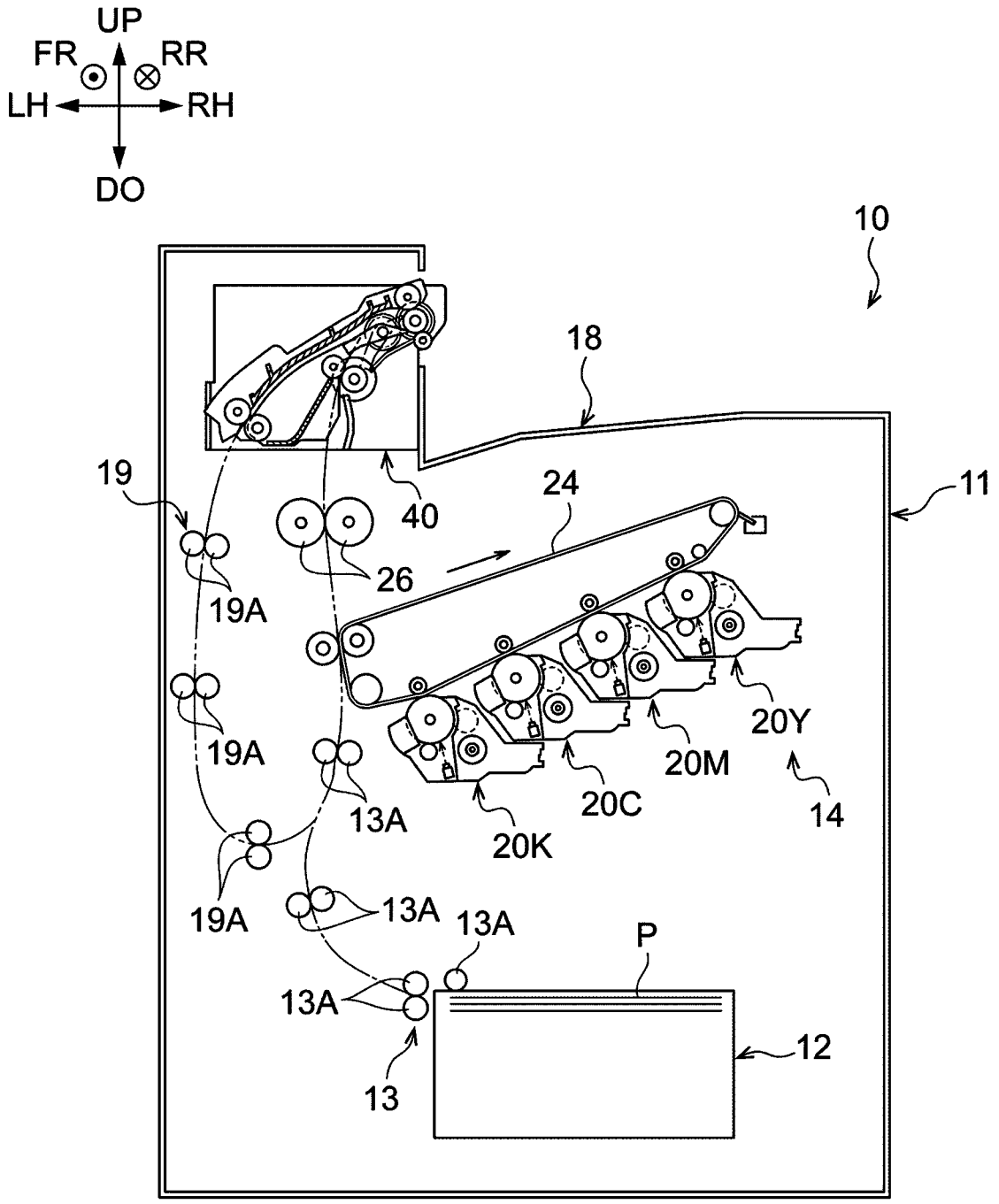
FIG. 1 is a schematic diagram illustrating a configuration of an image forming apparatus according to the present embodiment.

A configuration of an image forming apparatus 10 according to the present embodiment will be described. FIG. 1 is a schematic diagram illustrating the configuration of the image forming apparatus 10 according to the present embodiment.

An arrow UP illustrated in the drawing indicates an upper side of the apparatus (specifically, a vertical upper side), and an arrow DO indicates a lower side of the apparatus (specifically, a vertical lower side). An arrow LH illustrated in the drawing indicates a left side of the apparatus, and an arrow RH indicates a right side of the apparatus. An arrow FR in the drawing indicates a front side of the apparatus, and an arrow RR indicates a rear side of the apparatus. Since these directions are defined for the sake of convenience in description, the apparatus configuration is not limited to these directions. The term "apparatus" may be omitted in each direction of the apparatus. That is, for example, an "upper side of the apparatus" may be simply referred to as an "upper side".

An up-down direction, a left-right direction, and a front-rear direction are directions intersecting each other (specifically, orthogonal directions). The up-down direction may be referred to as a vertical direction. The left-right direction and the front-rear direction may be referred to as a lateral direction and a horizontal direction, respectively. A symbol in which "x" is described in "○" in the drawing means an arrow from the front to the rear of a paper surface. A symbol in which "•" is described in "○" in the drawing means an arrow from the rear to the front of the paper surface.

The image forming apparatus 10 illustrated in FIG. 1 is an apparatus that forms an image. Specifically, as illustrated in FIG. 1, the image forming apparatus 10 includes an image forming apparatus body 11, an accommodation unit 12, a discharge unit 18, a first conveyance device 13, an image forming unit 14, a second conveyance device 40, and a third conveyance device 19. Each of the units in the image forming apparatus 10 will be described below.

(Image Forming Apparatus Body 11)

As illustrated in FIG. 1, the image forming apparatus body 11 is a portion in which the constituent units in the image forming apparatus 10 are provided. Specifically, for example, the accommodation unit 12, the first conveyance device 13, the image forming unit 14, the second conveyance device 40, and the third conveyance device 19 are disposed inside the image forming apparatus body 11.

(Accommodation Unit 12)

In the image forming apparatus 10, the accommodation unit 12 is a portion that accommodates a recording medium P. The recording medium P accommodated in the accommodation unit 12 is supplied to the image forming unit 14. The recording medium P accommodated in the accommodation unit 12 is an example of a material to be conveyed, and is a target on which an image is formed by the image forming unit 14. Examples of the recording medium P include a sheet and a film. Examples of the film include a resin film and a metal film. The recording medium P is not limited to the above-described recording medium, and various recording media may be used.

(Discharge Unit 18)

The discharge unit 18 is a portion of the image forming apparatus 10 from which the recording medium P is discharged. The discharge unit 18 from which the recording medium P having an image formed thereon by the image forming unit 14 is discharged.

(First Conveyance Device 13)

The first conveyance device 13 is a device that conveys the recording medium P accommodated in the accommodation unit 12 toward the image forming unit 14. Specifically, as illustrated in FIG. 1, the first conveyance device 13 includes conveyance members 13A such as a plurality of conveyance rollers, and conveys the recording medium P by the conveyance members 13A.

(Image Forming Unit 14)

The image forming unit 14 has a function of forming an image on the recording medium P conveyed by the first conveyance device 13. The image forming unit 14 forms a toner image (an example of the image) on the recording medium P by an electrophotographic system. Specifically, as illustrated in FIG. 1, the image forming unit 14 includes toner image forming units 20Y, 20M, 20C, and 20K (hereinafter, referred to as 20Y to 20K), a transfer body 24, and a fixing unit 26.

In the image forming unit 14, the toner image forming units 20Y to 20K form toner images of colors of yellow (Y), magenta (M), cyan (C), and black (K) on the transfer body 24 by performing charging, exposing, developing, and transferring processes. In the image forming unit 14, the toner images of the colors formed on the transfer body 24 are transferred to the recording medium P, and the toner images are fixed onto the recording medium P by the fixing unit 26. As described above, in the image forming unit 14, an intermediate transfer system that transfers the image onto the recording medium P via the transfer body 24 is used.

(Second Conveyance Device 40)

Figure 6:
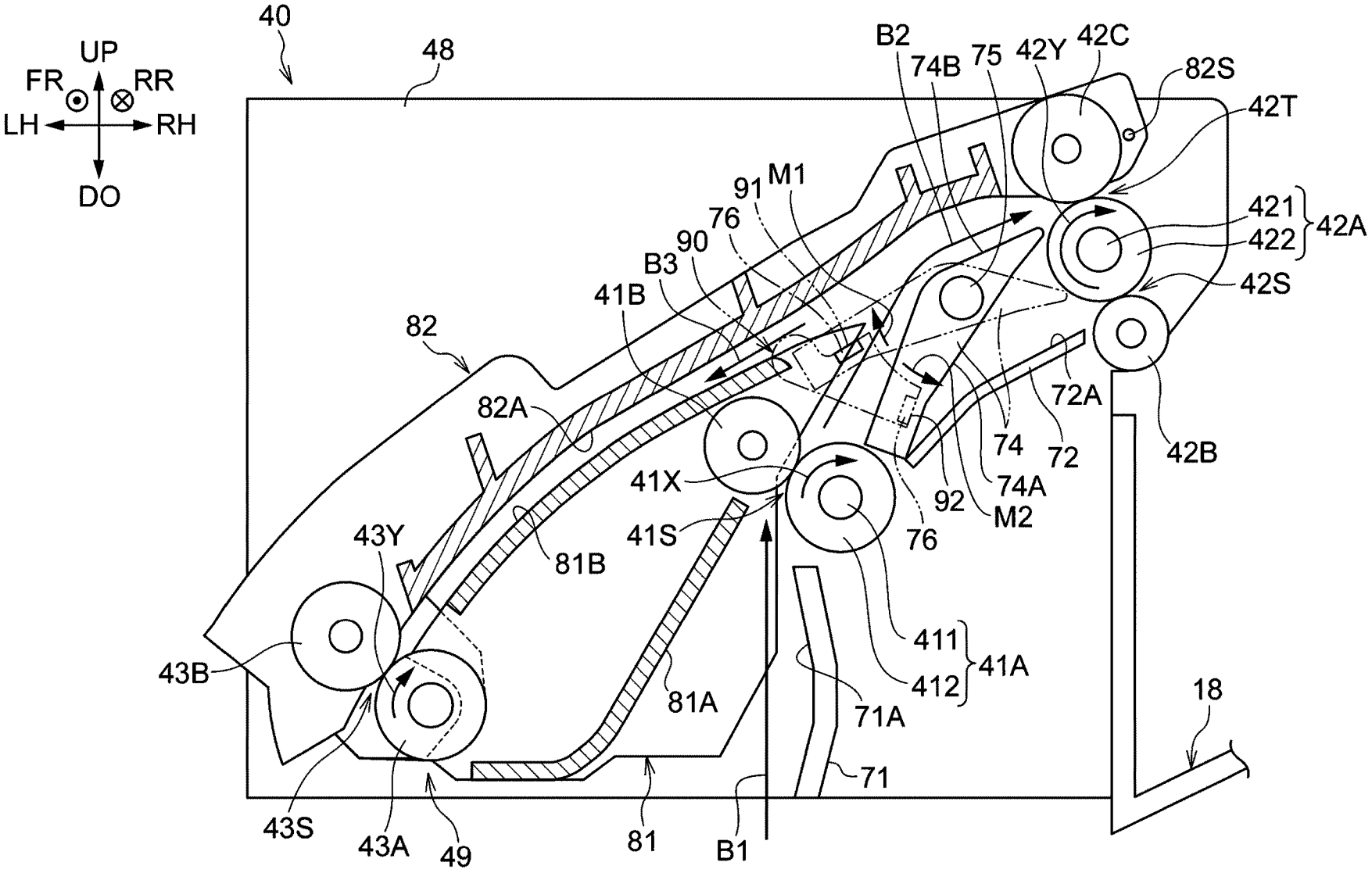
FIG. 6 is a front cross-sectional view of the second conveyance device according to the present embodiment.

The second conveyance device 40 is an example of a conveyance device, and is a device that conveys the recording medium P on which the image is formed by the image forming unit 14. More specifically, the second conveyance device 40 discharges the recording medium P on which the image is formed by the image forming unit 14 to the discharge unit 18 or inverts the recording medium P on which the image is formed by the image forming unit 14. That is, the second conveyance device 40 selectively conveys the recording medium P on which the image is formed by the image forming unit 14 along any one of a discharge path for discharging the recording medium and an inversion path for inverting the recording medium. The discharge path is a path indicated by arrows A1, A2, and A3 in FIG. 2. In FIG. 6, the inversion path includes a first inversion path indicated by arrows B1 and B2 and a second inversion path indicated by an arrow B3. That is, in the second conveyance device 40, the recording medium P conveyed along the first inversion path is conveyed along the first inversion path, is switched back, and is conveyed along the second inversion path. A specific configuration of the second conveyance device 40 will be described later.

(Third Conveyance Device 19)

The third conveyance device 19 is a device that conveys the recording medium P inverted by the second conveyance device 40 toward the image forming unit 14. That is, the recording medium P inverted by the second conveyance device 40 is conveyed to the image forming unit 14 again. Specifically, as illustrated in FIG. 1, the third conveyance device 19 includes conveyance members 19A such as a plurality of conveyance rollers, and conveys the recording medium P by the conveyance members 19A.

(Specific Configuration of Second Conveyance Device 40)

Figure 2:
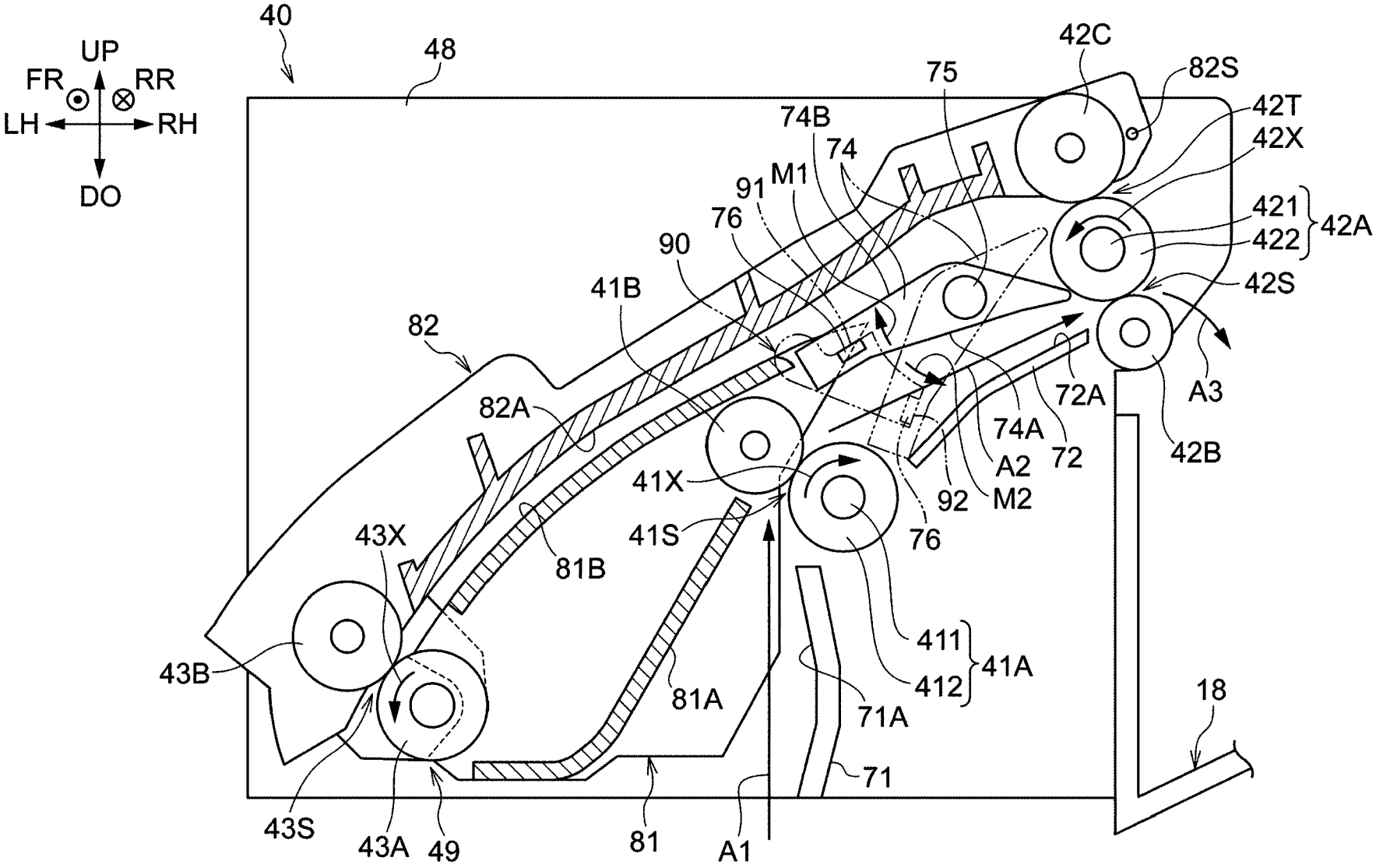
FIG. 2 is a front cross-sectional view of a second conveyance device according to the present embodiment.
Figure 3:
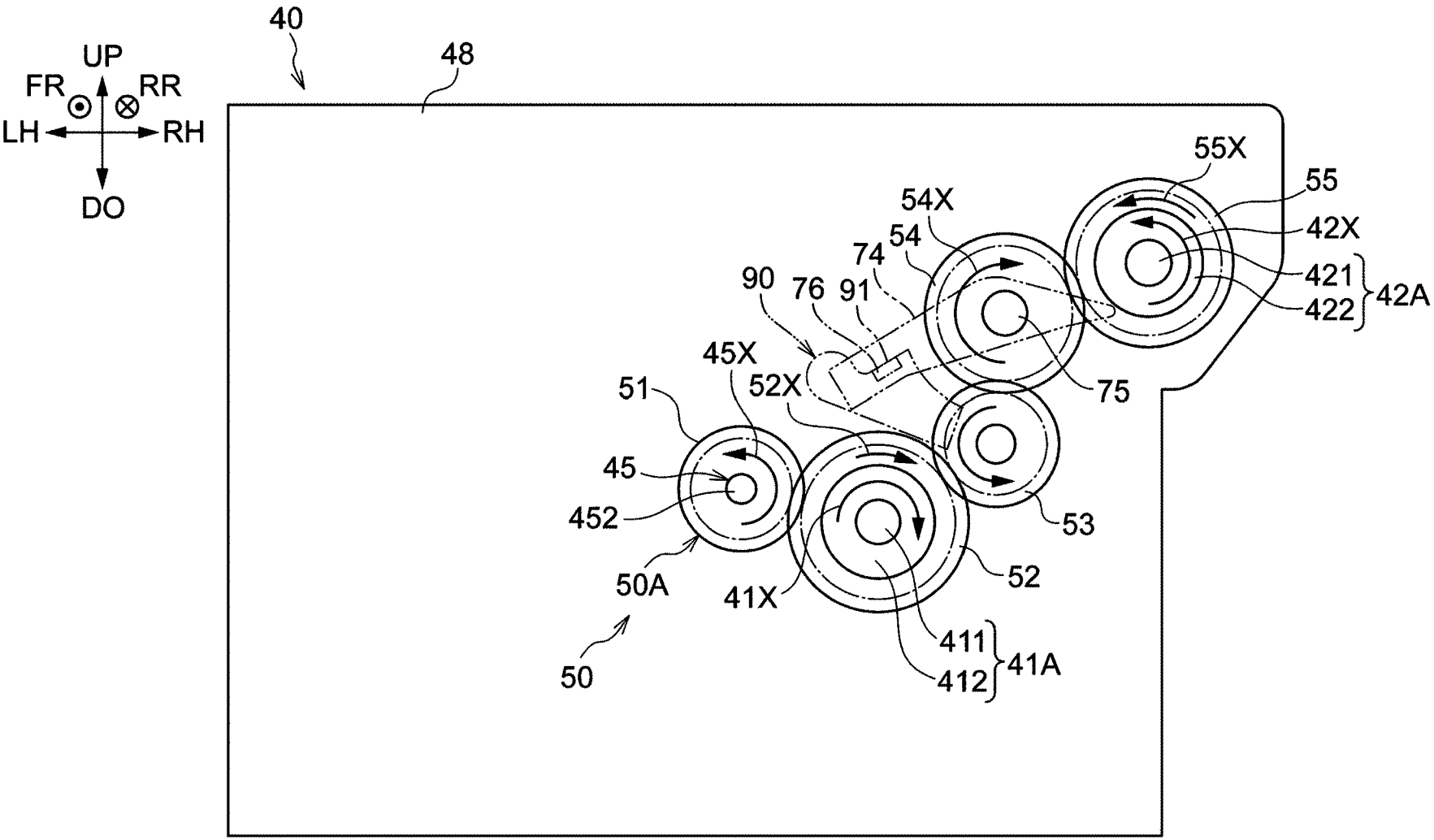
FIG. 3 is a front view illustrating a part of a transmission mechanism in the second conveyance device according to the present embodiment.
Figure 4:
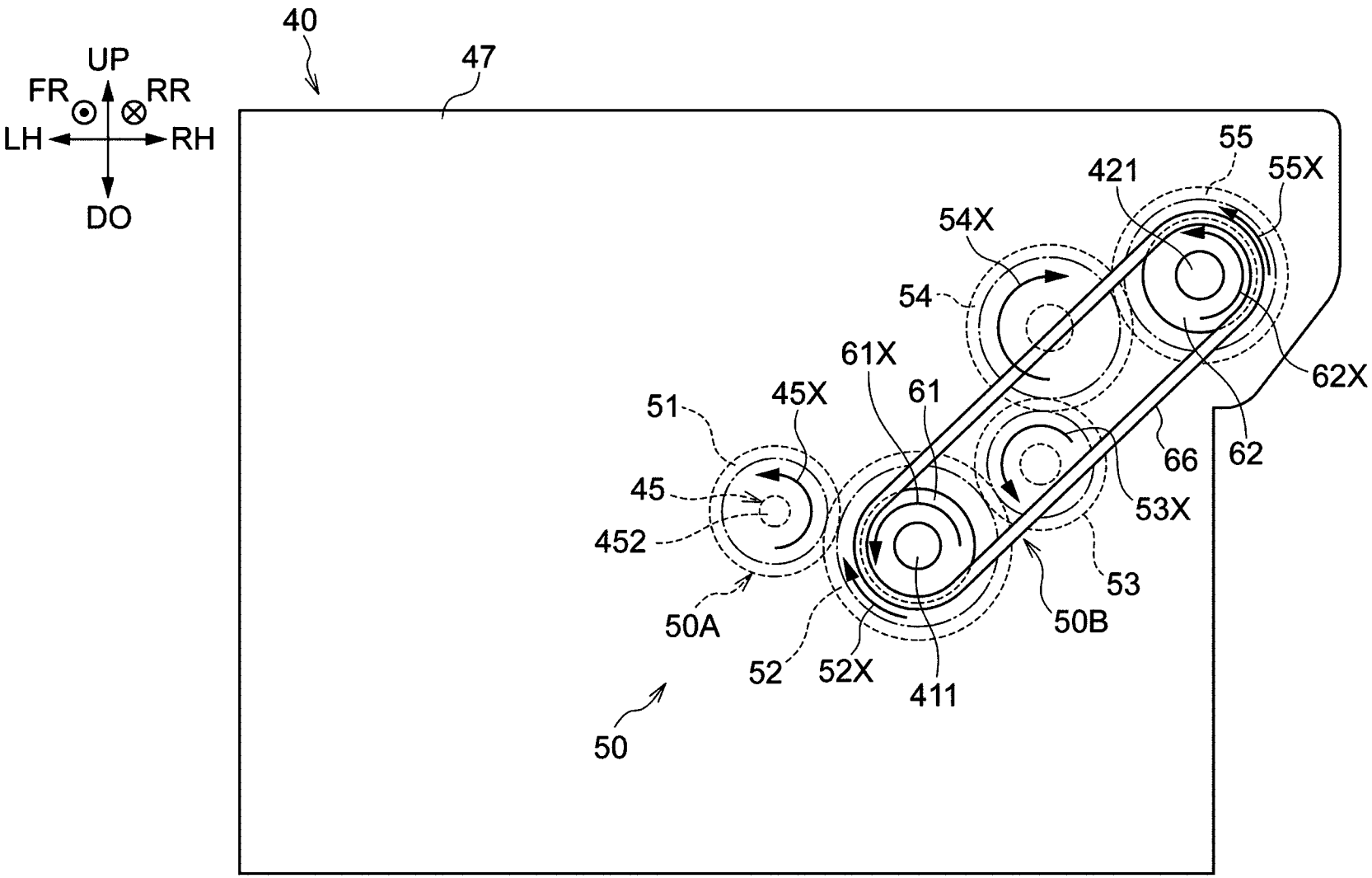
FIG. 4 is a front view illustrating the transmission mechanism in the second conveyance device according to the present embodiment.
Figure 5:
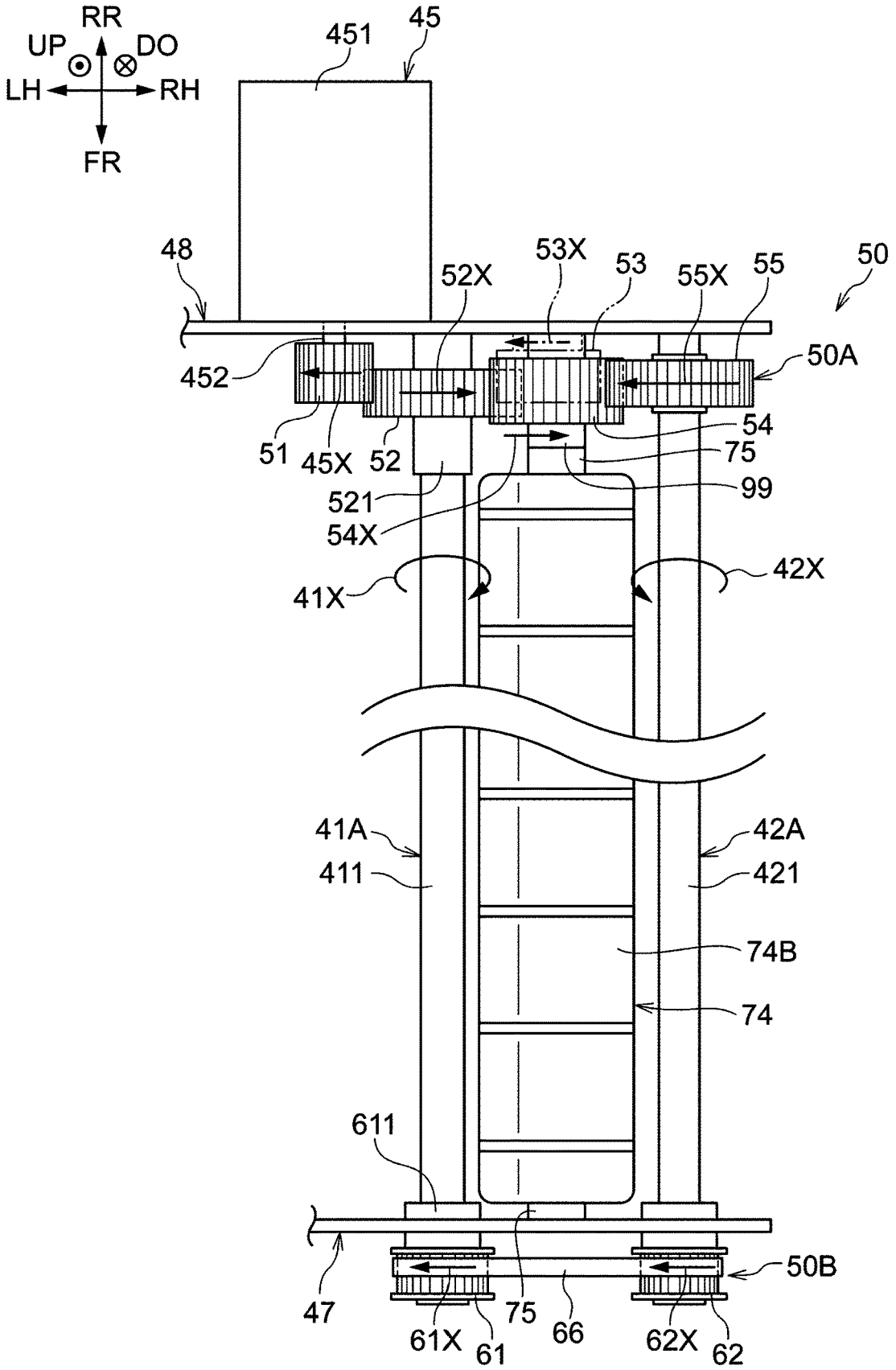
FIG. 5 is a plan view of the second conveyance device according to the present embodiment.
Figure 7:
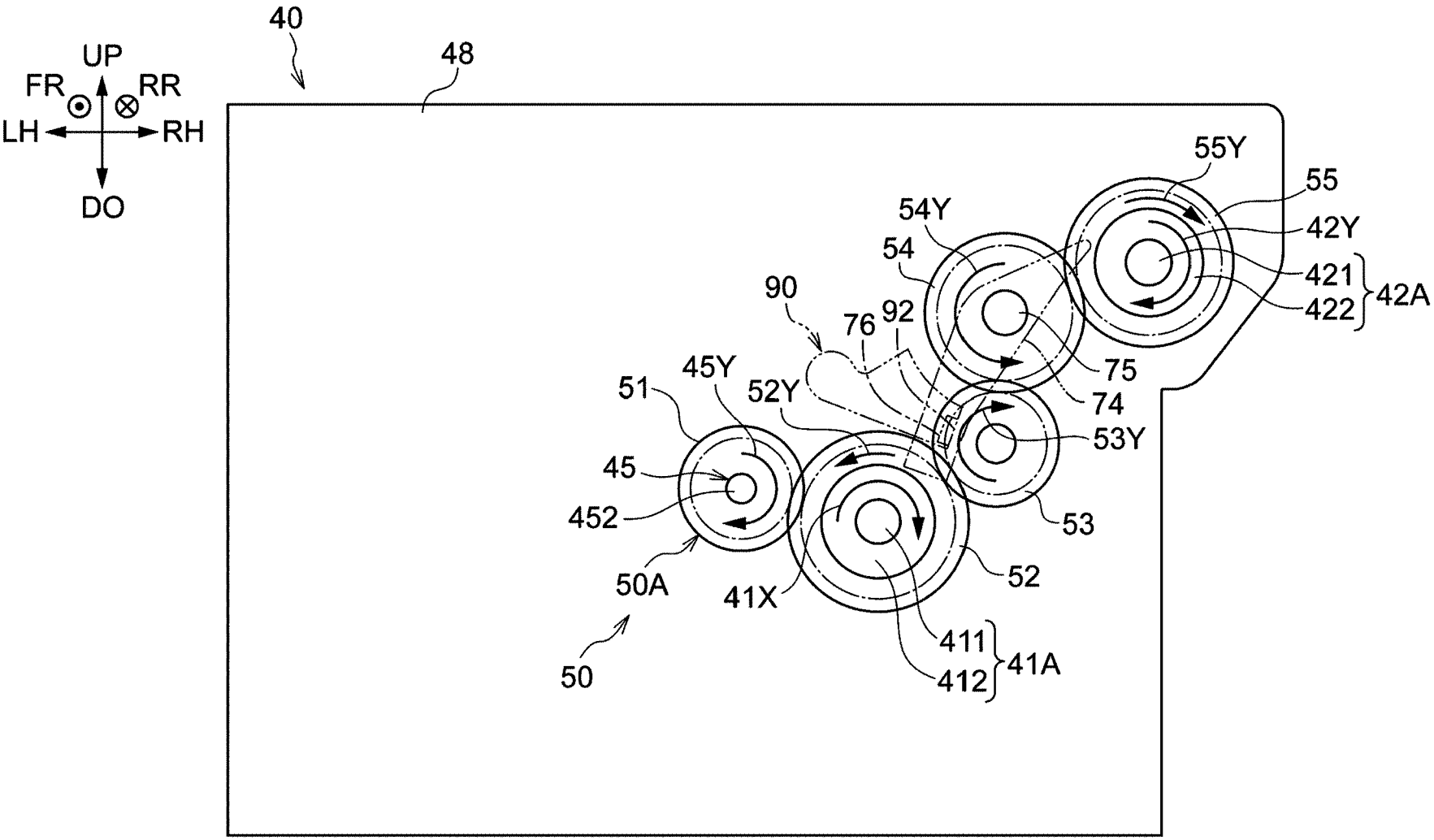
FIG. 7 is a front view illustrating a part of the transmission mechanism in the second conveyance device according to the present embodiment.
Figure 8:
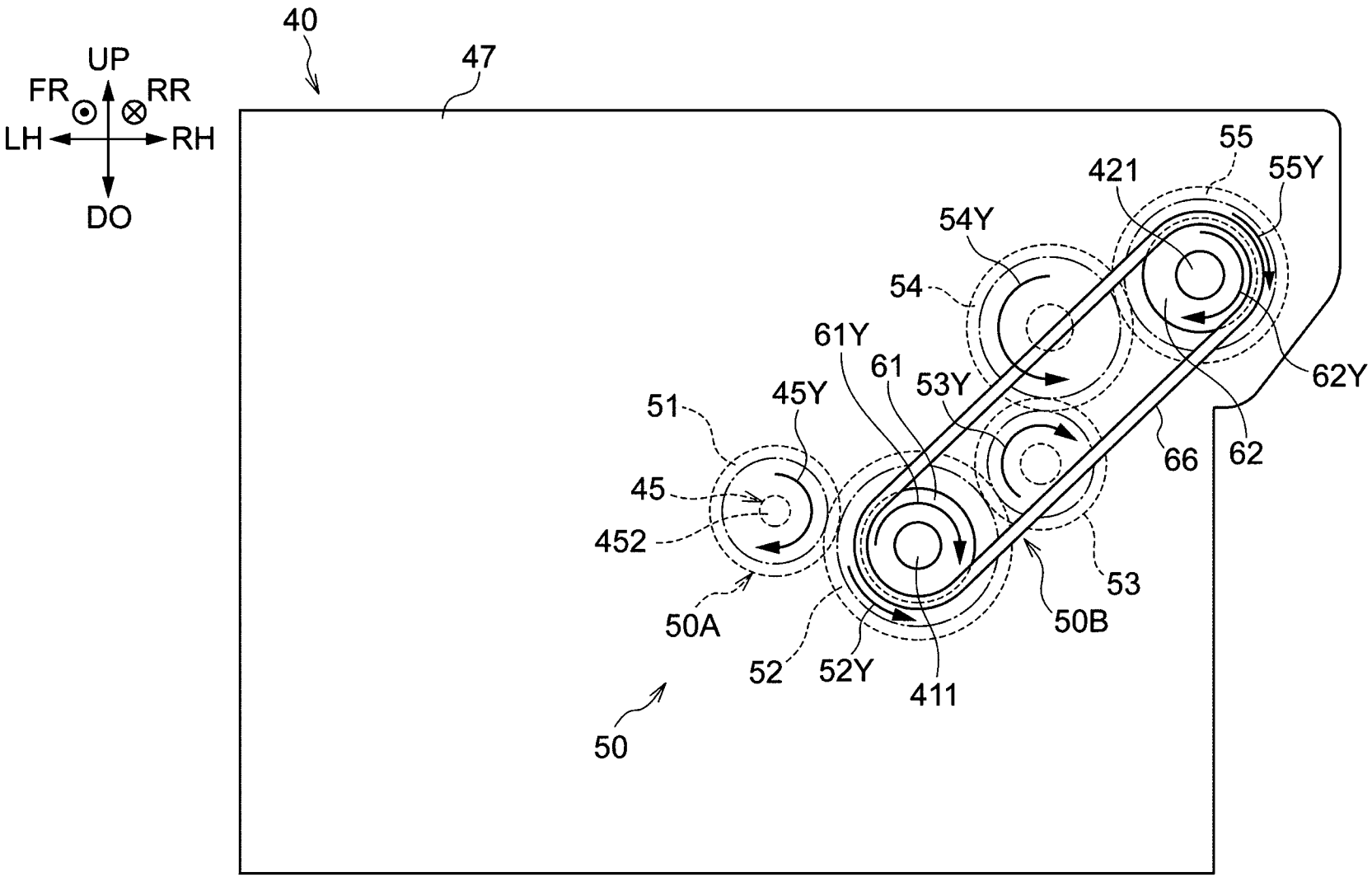
FIG. 8 is a front view illustrating the transmission mechanism in the second conveyance device according to the present embodiment.
Figure 9:
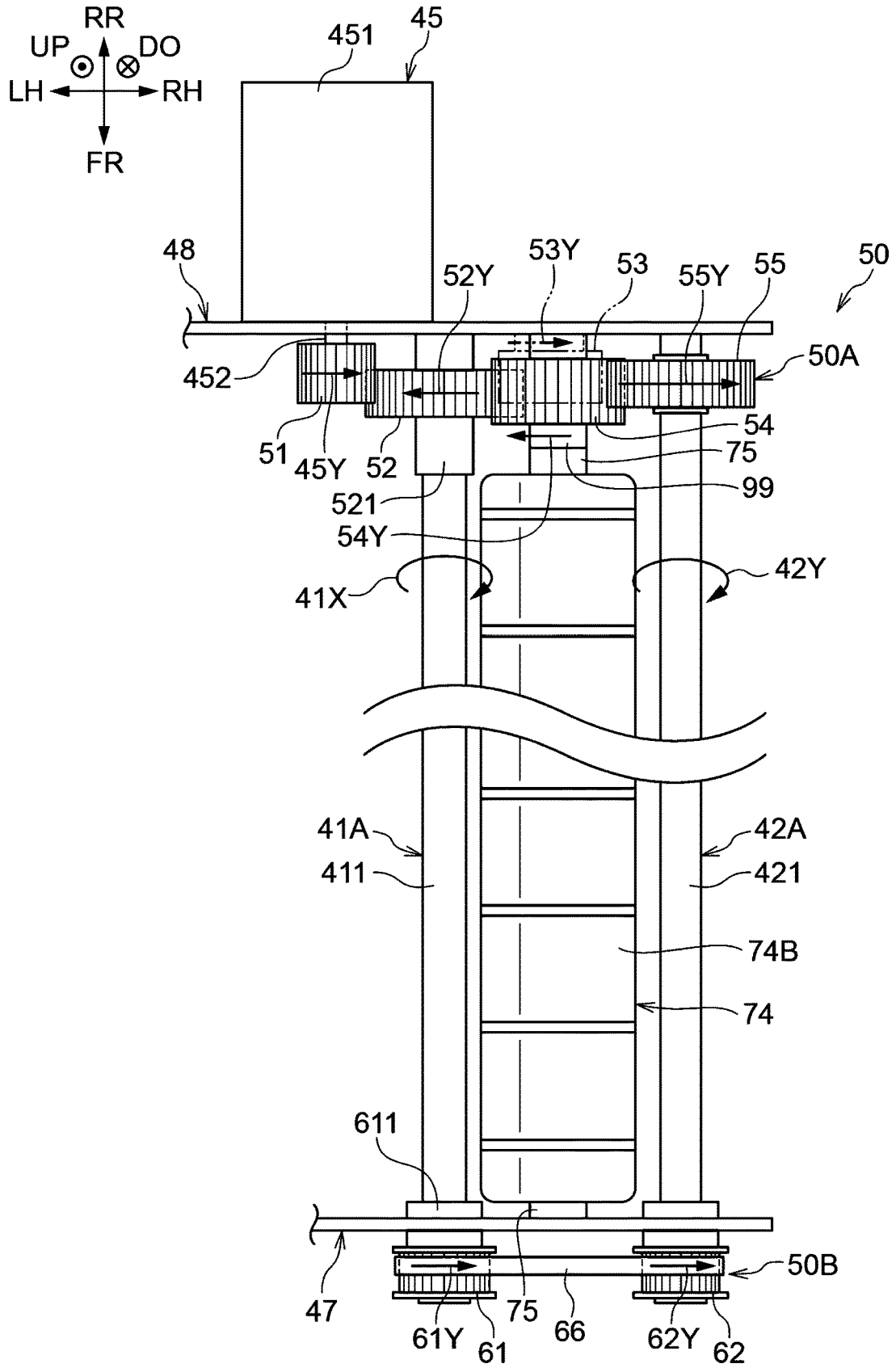
FIG. 9 is a plan view of the second conveyance device according to the present embodiment.

A specific configuration of the second conveyance device 40 will be described below. FIGS. 2 and 6 are front cross-sectional views of the second conveyance device 40. FIGS. 3 and 7 are front views illustrating a part of a transmission mechanism 50 (to be described later) in the second conveyance device 40. FIGS. 4 and 8 are front views illustrating a transmission mechanism 50 (to be described later) in the second conveyance device 40. FIGS. 5 and 9 are plan views of the second conveyance device 40.

Figure 10:
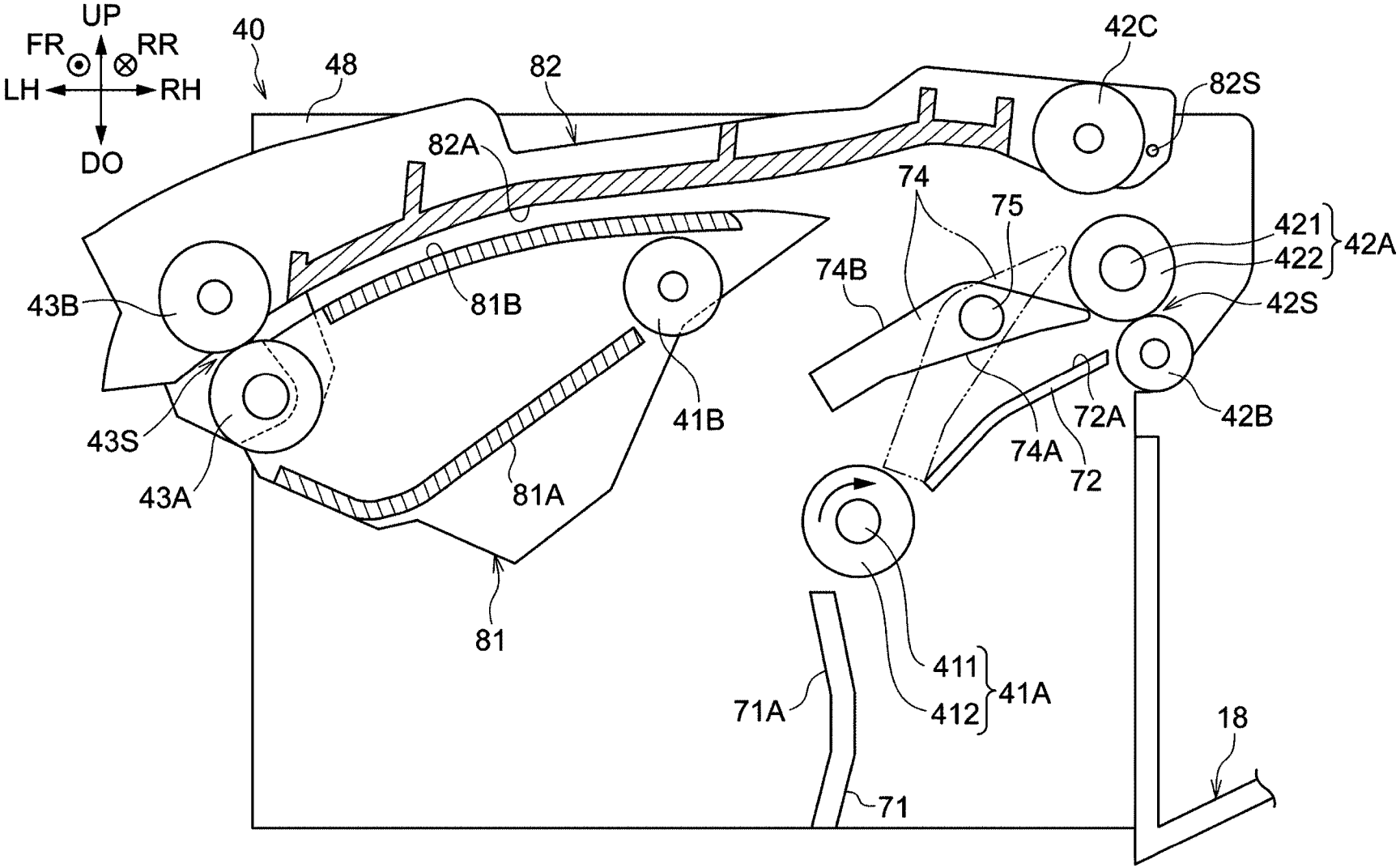
FIG. 10 is a front cross-sectional view illustrating a state where an opening and closing body in the second conveyance device according to the present embodiment is opened.
Figure 11:
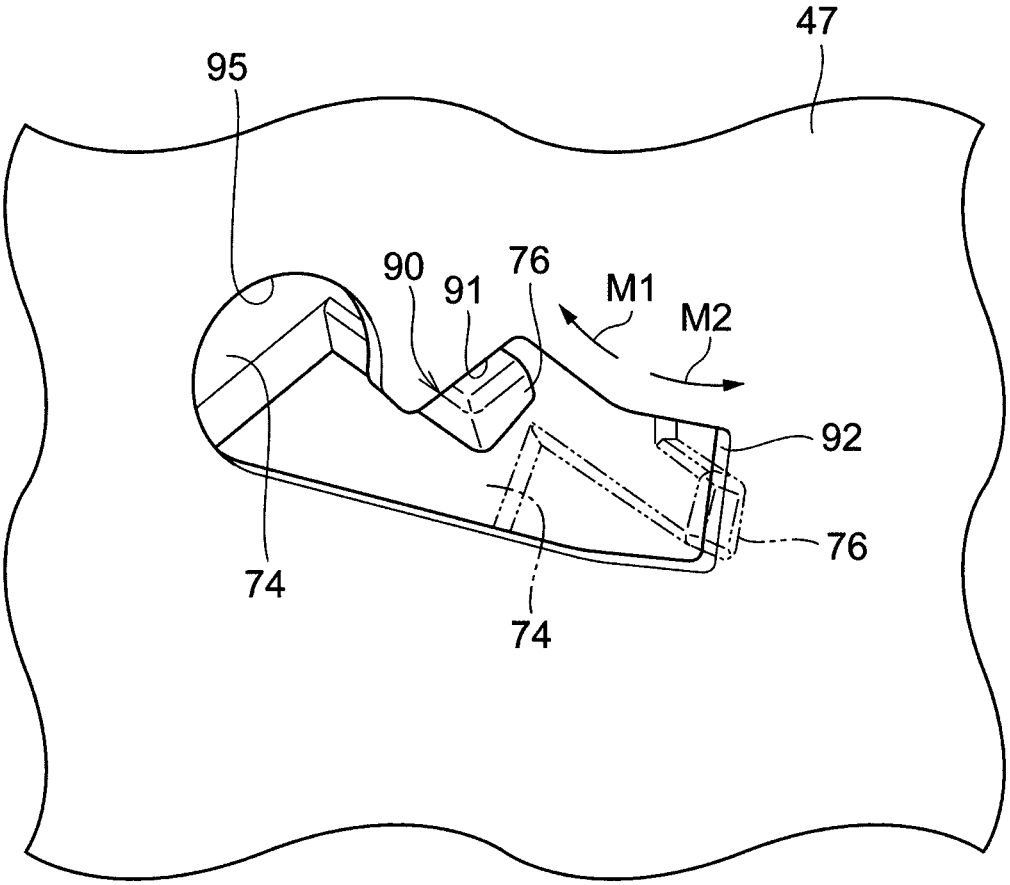
FIG. 11 is a perspective view illustrating a restriction mechanism according to the present embodiment.

FIGS. 2, 3, 4, and 5 illustrate the second conveyance device 40 when the recording medium P is discharged to the discharge unit 18. FIGS. 6, 7, 8, and 9 illustrate the second conveyance device 40 when the recording medium P is inverted. FIG. 10 is a front cross-sectional view illustrating a state where opening and closing bodies 81 and 82 (to be described later) in the second conveyance device 40 are opened. FIG. 11 is a perspective view of a restriction mechanism 90 (to be described later) in the second conveyance device 40.

As illustrated in FIGS. 2, 3, 4, and 5, the second conveyance device 40 includes support frames 47 and 48, a conveyance unit 49, guides 71, 72, and 74, a restriction mechanism 90, a driving motor 45, a transmission mechanism 50, a blocking mechanism 99, and the opening and closing bodies 81 and 82.

(Support Frames 47 and 48)

The support frames 47 and 48 illustrated in, for example, FIG. 5 are examples of support bodies and have a function of supporting constituent units of the second conveyance device 40 including driving rollers 41A and 42A, a driving motor 45, and a guide 74, which will be described below. As illustrated in FIG. 5, the support frames 47 and 48 are formed in a shape of, for example, a plate of which a thickness direction is the front-rear direction.

The support frame 47 constitutes a front portion in the second conveyance device 40 and is disposed on a front side of the support frame 48. The support frame 48 constitutes a rear portion in the second conveyance device 40 and is disposed on a rear side of the support frame 47.

(Conveyance Unit 49)

The conveyance unit 49 is a constituent unit that conveys the recording medium P. The conveyance unit 49 includes driving rollers 41A, 42A, and 43A and driven rollers 41B, 42B, 42C, and 43B.

The driving rollers 41A, 42A, and 43A illustrated in, for example, FIG. 2 are conveyance rollers serving as driven units that are rotationally driven by the driving motor 45 (see FIG. 5). Specifically, as illustrated in FIG. 2, the driving rollers 41A and 42A include shaft units 411 and 421 and roller units 412 and 422 provided on the outer peripheries of the shaft units 411 and 421, respectively. As illustrated in FIG. 5, the driving rollers 41A and 42A are supported such that one end portions (specifically, front end portions) and the other end portions (specifically, rear end portions) are rotatable about the support frames 47 and 48 by the shaft units 411 and 421. In FIG. 5, the driving rollers 41A and 42A are illustrated with the roller units 412 and 422 being omitted.

The driving roller 41A is an example of a first conveyance member, and conveys the recording medium P by rotating forward (rotating in a direction of an arrow 41X). As will be described below, the driving roller 41A is rotated forward by a driving force of the driving motor 45 transmitted by the transmission mechanism 50.

As illustrated in FIG. 2, the driving roller 41A has an outer peripheral surface in contact with an outer peripheral surface of the driven roller 41B, and has a contact region 41S in contact with the driven roller 41B. The driven roller 41B is a conveyance roller that rotates by being driven by the driving roller 41A by coming into contact with the driving roller 41A in the contact region 41S. The driving roller 41A and the driven roller 41B are disposed on a downstream side of the image forming unit 14 in a conveyance direction (specifically, the fixing unit 26) illustrated in FIG. 1. The driving roller 41A and the driven roller 41B convey the recording medium P conveyed from the image forming unit 14 (specifically, the fixing unit 26) toward the downstream side in the conveyance direction (specifically, the driving roller 42A) while nipping the recording medium in the contact region 41S. The driven roller 41B is rotatably supported by the opening and closing body 81.

The driving roller 42A is an example of a second conveyance member, and conveys the recording medium P by rotating forward (rotating in a direction of an arrow 42X) and rotating backward (rotating in a direction of an arrow 42Y). As will be described below, the driving roller 42A is rotated forward and backward by the driving force of the driving motor 45 transmitted by the transmission mechanism 50.

The driven roller 42B is disposed on one side (specifically, a lower side) of the driving roller 42A. The driven roller 42C is disposed on side (specifically, an upper side) of the driving roller 42A opposite the driven roller 42B.

The driving roller 42A has an outer peripheral surface in contact with outer peripheral surfaces of the driven rollers 42B and 42C and has contact regions 42S and 42T in contact with the driven rollers 42B and 42C. The driven rollers 42B and 42C are conveyance rollers that rotate by being driven by the driving roller 42A by coming into contact with the driving roller 42A in the contact regions 42S and 42T. The driving roller 42A and the driven rollers 42B and 42C are disposed on a downstream side of the driving roller 41A and the driven roller 41B in a conveyance direction. When the recording medium P conveyed from the driving roller 41A and the driven roller 41B is discharged to the discharge unit 18, the driving roller 42A conveys the recording medium P together with the driven roller 42B by rotating forward. Specifically, the driving roller 42A rotates forward, and thus, the driving roller A2 and the driven roller A3 discharge the recording medium P to the discharge unit 18 along the discharge path (see arrows 42A and 42B) while being nipped in the contact region 42S. At this time, the guide 74 is positioned at a discharge position (a position indicated by a solid line in FIG. 2).

When the recording medium P conveyed from the driving roller 41A and the driven roller 41B is inverted, as illustrated in FIG. 6, the driving roller 42A conveys the recording medium P together with the driven roller 42C by rotating backward. Specifically, the driving roller 42A rotates backward, and thus, the driving roller 42A and the driven roller 42C convey the recording medium P in the first inversion path (see the arrow B2) while nipping the recording medium P in the contact region 42T. At this time, the guide 74 is positioned at an inversion position (a position indicated by a solid line in FIG. 6).

Thereafter, the driving roller 42A rotates forward, and thus, the driving roller 42A and the driven roller 42C convey the recording medium P along the second inversion path (see the arrow B3). At this time, the guide 74 is positioned at a discharge position (a position indicated by a dashed double-dotted line in FIG. 6). As described above, the driving roller 42A rotates forward after rotating backward, the driving roller 42A and the driven roller 42C invert the recording medium P.

The driven roller 42B is rotatably supported by the support frames 47 and 48. The driven roller 42C is rotatably supported by the opening and closing body 82.

The driving roller 43A is rotatable forward (rotating in a direction of an arrow 43X in FIG. 2) and backward (rotating in a direction of an arrow 43Y in FIG. 6). The driving roller 43A has an outer peripheral surface in contact with an outer peripheral surface of the driven roller 43B, and has a contact region 43S in contact with the driven roller 43B. The driven roller 43B rotates by being driven by the driving roller 43A by coming into contact with the driving roller 43A in the contact region 43S. The driving roller 43A and the driven roller 43B are disposed on a downstream side of the driving roller 42A and the driven roller 42C in a conveyance direction.

The driving roller 43A and the driven roller 43B convey the recording medium P conveyed from the driving roller 42A and the driven roller 42C toward the downstream side in the conveyance direction (specifically, toward the image forming unit 14) while nipping the recording medium P in the contact region 43S. The driving roller 43A and the driven roller 43B are rotatably supported by the opening and closing body 82.

(Guides 71 and 72)

The guides 71 and 72 illustrated in FIG. 2 has a function of guiding the recording medium P. As illustrated in FIG. 2, the guide 71 is disposed on an upstream side of the driving roller 41A in a conveyance direction and on a downstream side of the fixing unit 26 in a conveyance direction. Specifically, the guide 71 is disposed on a lower side of the driving roller 41A. The guide 71 guides the recording medium P toward the downstream side in the conveyance direction (specifically, toward the contact region 41S of the driving roller 41A) by bringing the recording medium P into contact with a guide surface 71A facing a left side in FIG. 2.

The guide 72 is disposed on a downstream side of the driving roller 41A in a conveyance direction and on an upstream side of the driving roller 42A in a conveyance direction. Specifically, in FIG. 2, the guide 72 is disposed on an obliquely upper right side of the driving roller 41A and on an obliquely lower left side of the driving roller 42A. The guide 72 guides the recording medium P toward the downstream side in the conveyance direction (specifically, toward the contact region 42S of the driving roller 42A) by bringing the recording medium P into contact with a guide surface 72A facing an upper side in FIG. 2.

(Guide 74)

The guide 74 illustrated in FIG. 2 is an example of a guide unit and has a function of guiding the recording medium P. As illustrated in FIG. 2, the guide 74 is disposed between the driving roller 41A and the driving roller 42A. That is, the guide 74 is disposed on a downstream side of the driving roller 41A in a conveyance direction and on an upstream side of the driving roller 42A in a conveyance direction.

The guide 74 is rotatable between a discharge position at which the discharge path is formed (a position indicated by a solid line in FIG. 2) and an inversion position at which the inversion path is formed (a position indicated by a dashed double-dotted line in FIG. 2). Specifically, as illustrated in FIG. 5, the guide 74 is rotatably supported by the support frames 47 and 48 between the discharge position and the inversion position by a rotary shaft 75 provided at one end portion (specifically, a front end) and the other end portion (specifically, a rear end).

As illustrated in FIG. 2, the guide 74 forms the discharge path (specifically, the path from the contact region 41S to the contact region 42S (see an arrow A2)) between the guide 74 and the guide 72 at the discharge position. The guide 74 guides the recording medium P along a guide surface 74A facing a lower side at the discharge position.

At the inversion position, the guide 74 forms the first inversion path (specifically, the path from the contact region 41S to the contact region 42T (see the arrow B2 in FIG. 6)) between the opening and closing bodies 81 and 82. The guide 74 guides the recording medium P along a guide surface 74B that faces a left side at the inversion position.

The above-described discharge path is an example of a first conveyance path, and the discharge position of the guide 74 is an example of a first position. The above-described inversion path is an example of a second conveyance path, and the inversion position of the guide 74 is an example of a second position. The inversion path may be considered as an example of the first conveyance path, the inversion position may be considered as an example of the first position, the discharge path may be considered as an example of the second conveyance path, and the discharge position may be considered as an example of the second position.

In the present embodiment, the guide 74 is driven by the driving force of the driving motor 45. Specifically, as will be described below, the guide 74 rotates between the discharge position and the inversion position by the driving force of the driving motor 45 transmitted by the transmission mechanism 50.

As illustrated in FIGS. 2 and 11, the guide 74 includes a projection 76 serving as a contacted portion that comes into contact with contact surfaces 91 and 92 to be described later. The projection 76 is disposed on an upstream side of the rotary shaft 75 in a conveying direction in the guide 74. The projection 76 projects a front side from the guide 74.

(Driving Motor 45 and Transmission Mechanism 50)

The driving motor 45 illustrated in, for example, FIG. 5 is an example of a driving unit and drives the conveyance unit 49 and the guide 74. As illustrated in FIG. 5, the driving motor 45 includes a body 451 and a driving shaft 452. The body 451 is fixed to the support frame 48 on the rear side of the support frame 48. The driving shaft 452 extends from the body 451 toward a front side of the support frame 48. For example, a stepping motor is used as the driving motor 45.

The transmission mechanism 50 illustrated in, for example, FIG. 5 is a mechanism that transmits the driving force of the driving motor 45 to the driving roller 41A, 42A, and 43A and the guide 74. In the present embodiment, the transmission mechanism 50 transmits the driving force in a forward rotation direction (in a direction of an arrow 45X) output from the driving motor 45 to the driving rollers 41A and 42A, and thus, the driving rollers 41A and 42A are rotated forward. The transmission mechanism 50 transmits the driving force in a backward rotation direction (a direction of an arrow 45Y) output from the driving motor 45 to the driving rollers 41A and 42A, and thus, the driving roller 41A is rotated forward and the driving roller 42A is rotated backward.

In the present embodiment, as illustrated in FIGS. 3, 4, and 5, the transmission mechanism 50 includes, as constituent elements, gears 51, 52, 53, 54, and 55, pulleys 61 and 62, a timing belt 66, and one-way clutches 521 and 611.

The gear 51 is fixed to the driving shaft 452 of the driving motor 45. The gear 52 meshes with the gear 51, and is fixed to a rear end portion of the shaft unit 411 of the driving roller 41A via the one-way clutch 521. The one-way clutch 521 functions as a transmission unit that transmits a rotational force of the gear 52 in a forward rotation direction (a direction of an arrow 52X in, for example, FIG. 3) to the shaft unit 411 of the driving roller 41A and does not transmit a rotational force of the gear 52 in a backward rotation direction (a direction of an arrow 52Y in, for example, FIG. 7) to the shaft unit 411 of the driving roller 41A.

The gear 53 meshes with the gear 52 and is rotatably supported by the support frame 48. The gear 54 meshes with the gear 53 and is fixed to the rotary shaft 75 of the guide 74. The gear 55 meshes with the gear 54, and is fixed to a rear end portion of the shaft unit 421 of the driving roller 42A.

The pulley 61 is fixed to a front end portion of the shaft unit 411 of the driving roller 41A via a one-way clutch 611. The one-way clutch 611 functions as a transmission unit that transmits a rotational force of the pulley 61 in a backward rotation direction (a direction of an arrow 61Y in, for example, FIGS. 8 and 9) to the shaft unit 411 of the driving roller 41A and does not transmit a rotational force of the pulley 61 in a forward rotation direction (a direction of an arrow 61X in, for example, FIGS. 4 and 5) to the shaft unit 411 of the driving roller 41A.

The pulley 62 is fixed to a front end portion of the shaft unit 421 of the driving roller 42A. The pulley 62 is rotatable together with the driving roller 42A in a forward rotation direction (a direction of an arrow 62X) and a backward rotation direction (a direction of an arrow 62Y). The timing belt 66 has an annular shape and is wound around the pulleys 61 and 62. Teeth formed on an inner periphery of the timing belt 66 mesh with teeth formed on outer peripheries of the pulleys 61 and 62.

As described above, in the transmission mechanism 50, the gears 51, 52, 53, 54, and 55 and the one-way clutch 521 are disposed at one end side (specifically, a rear end side) of the driving rollers 41A and 42A in an axial direction, and the pulleys 61 and 62, the timing belt 66, and the one-way clutch 611 are disposed at the other end side (specifically, a front end side) of the driving rollers 41A and 42A in the axial direction.

The transmission mechanism 50 includes a first transmission path 50A and a second transmission path 50B formed by the above-described constituent elements. The first transmission path 50A is a path through which the driving force output from the driving motor 45 in the forward rotation direction (the direction of the arrow 45X) is transmitted to the driving rollers 41A and 42A to cause the driving rollers 41A and 42A to rotate forward and through which the driving force output from the driving motor 45 in the backward rotation direction (the direction of the arrow 45Y) is not transmitted to the driving rollers 41A. The first transmission path 50A is a path for moving the guide 74 in a moving direction from the inversion position to the discharge position (hereinafter, referred to as a first moving direction). The first moving direction is a direction indicated by an arrow M1 in the drawing.

The second transmission path 50B is a path through which the driving force output from the driving motor 45 in the backward rotation direction (the direction of the arrow 45Y) is transmitted to the driving rollers 41A and 42A to cause the driving roller 41A to rotate forward and the driving roller 42A to rotate backward and through which the driving force output from the driving motor 45 in the forward rotation direction (the direction of the arrow 45X) is not transmitted to the driving roller 41A. The second transmission path 50B is a path for moving the guide 74 in a moving direction from the discharge position to the inversion position (hereinafter, referred to as a second moving direction). The second moving direction is a direction indicated by an arrow M2 in the drawing.

In the first transmission path 50A, as illustrated in FIGS. 3, 4, and 5, the driving force from the driving motor 45 in the forward rotation direction (the direction of the arrow 45X) is transmitted to the gears 51, 52, 53, 54, and 55 in this order, and the gears 51, 52, 53, 54, and 55 rotate in the forward rotation direction (the direction of the arrow 45X, the direction of the arrow 52X, the direction of the arrow 53X, the direction of the arrow 54X, and the direction of the arrow 55X). The rotational force of the gear 52 in the forward rotation direction (the direction of the arrow 52X) is transmitted to the shaft unit 411 of the driving roller 41A via the one-way clutch 521, and thus, the driving roller 41A rotates forward. The rotational force of the gear 54 in the forward rotation direction (the direction of the arrow 54X) is transmitted to the rotary shaft 75, and the guide 74 moves in the first moving direction. The rotational force of the gear 55 in the forward rotation direction (the direction of the arrow 55X) is transmitted to the shaft unit 421 of the driving roller 42A, and thus, the driving roller 42A rotates forward. As described above, the first transmission path 50A is a path through which the driving force is transmitted to the driving roller 41A from one end side (specifically, a rear end side). The first transmission path 50A is a path formed by the gears 51, 52, 53, 54, and 55 and the one-way clutch 521.

When the driving roller 42A rotates forward, the rotational force of the shaft unit 421 of the driving roller 42A in the forward rotation direction is also transmitted to the pulley 62, the timing belt 66, and the pulley 61, but is not transmitted to the driving roller 41A through the path from the pulley 61 to the shaft unit 411 of the driving roller 41A (that is, the second transmission path 50B) due to an action of the one-way clutch 611.

In the second transmission path 50B, as illustrated in FIGS. 7, 8, and 9, the driving force from the driving motor 45 in the backward rotation direction (the direction of the arrow 45Y) is transmitted to the gears 51, 52, 53, 54, and 55 in this order, and the gears 51, 52, 53, 54, and 55 rotate in the backward rotation direction (the direction of the arrow 45Y, the direction of the arrow 52Y, the direction of the arrow 53Y, the direction of the arrow 54Y, and the direction of the arrow 55Y). The rotational force of the gear 54 in the backward rotation direction (the direction of the arrow 54Y) is transmitted to the rotary shaft 75, and the guide 74 moves in the second moving direction. The rotational force of the gear 55 in the backward rotation direction (the direction of the arrow 55Y) is transmitted to the shaft unit 421 of the driving roller 42A, and thus, the driving roller 42A rotates backward. The rotational force of the shaft unit 421 of the driving roller 42A in the backward rotation direction is transmitted to the shaft unit 411 of the driving roller 41A via the pulley 62, the timing belt 66, the pulley 61, and the one-way clutch 611, and thus, the driving roller 42A rotates forward. As described above, the second transmission path 50B is a path through which the driving force is transmitted to the driving roller 41A from the other end side (specifically, a front end side). The second transmission path 50B is formed by the gears 51, 52, 53, 54, and 55, the pulleys 61 and 62, the timing belt 66, and the one-way clutch 611.

The driving force of the driving motor 45 in the backward rotation direction (the direction of the arrow 45Y) is not transmitted to the driving roller 41A through the path from the gear 52 to the shaft unit 411 of the driving roller 41A (that is, the first transmission path 50A) due to an action of the one-way clutch 521.

As described above, the transmission mechanism 50 rotates the driving roller 41A forward by transmitting the driving force from the driving motor 45 in the forward rotation direction (the direction of the arrow 45X) through the path from the gear 52 to the shaft unit 411 of the driving roller 41A (that is, through the first transmission path 50A) and transmitting the driving force from the driving motor 45 in the backward rotation direction (the direction of the arrow 45Y) through the path from the pulley 61 to the shaft unit 411 of the driving roller 41A (that is, through the second transmission path 50B). That is, in the transmission mechanism 50, regardless of whether the driving force output from the driving motor 45 is in the forward rotation direction (the direction of the arrow 45X) or in the backward rotation direction (the direction of the arrow 45Y), the driving roller 41A is rotated forward.

In the transmission mechanism 50, transmission members (not illustrated) (a gear, a belt, and the like) transmit the driving force from the driving motor 45 in the forward rotation direction (the direction of the arrow 45X) to the driving roller 43A to rotate the driving roller 43A forward, and transmit the driving force from the driving motor 45 in the backward rotation direction (the direction of the arrow 45Y) to rotate the driving roller 43A backward. As described above, in the transmission mechanism 50, the driving rollers 41A, 42A, and 43A and the guide 74 are operated in cooperation with each other.

(Restriction Mechanism 90)

The restriction mechanism 90 illustrated in FIGS. 2 and 11, and the like is a mechanism that restricts the movement (specifically, the rotation) of the guide 74. The restriction mechanism 90 includes the contact surfaces 91 and 92 that come into contact with the projection 76. The contact surfaces 91 and 92 are provided on the support frame 47 by forming a cutout 95 (see FIG. 11) in the support frame 47.

The contact surface 91 is an example of a first restriction unit, and is a surface facing an obliquely lower right side in FIG. 2. The contact surface 92 is an example of a second restriction unit, and is a surface facing an obliquely upper left side in FIG. 2.

The contact surface 91 comes into contact with the guide 74 moving to the discharge position from the inversion position in the first moving direction by the driving force of the driving motor 45 to restrict the movement of the guide 74 in the first moving direction. Accordingly, the guide 74 is positioned at the discharge position, and is restricted from moving in the first moving direction beyond the discharge position.

The contact surface 92 comes into contact with, at the inversion position, the guide 74 moving to the inversion position from the discharge position in the second moving direction by the driving force of the driving motor 45 to restrict the movement of the guide 74 in the second moving direction. Accordingly, the guide 74 is positioned at the inversion position, and is restricted from moving in the second moving direction beyond the inversion position.

Each of the contact surface 91 and the contact surface 92 is also an example of the restriction unit. The contact surface 92 may be grasped as an example of the first restriction unit, and the contact surface 91 may be grasped as an example of the second restriction unit.

(Driving of Driving Motor 45)

For example, the driving motor 45 starts outputting the driving force in the forward rotation direction or the backward rotation direction such that the movement of the guide 74 to the inversion position or the discharge position is completed before a distal end of the recording medium P conveyed by the conveyance unit 49 reaches the guide 74.

Even after the guide 74 moves to the inversion position or the discharge position, the driving motor 45 conveys the recording medium P along the discharge path or the inversion path by continuing to output the driving force in the forward rotation direction or the backward rotation direction. Thus, even after the guide 74 comes into contact with the contact surface 91 or the contact surface 92, the driving force may be output from the driving motor 45, and a moving load greater than or equal to a predetermined load may act on the guide 74.

In the present embodiment, a driving speed of the driving motor 45 until the guide 74 positioned at the inversion position is brought into contact with the contact surface 91 at the discharge position is less than a driving speed after the guide 74 is brought into contact with the contact surface 91. A driving speed of the driving motor 45 until the guide 74 positioned at the discharge position is brought into contact with the contact surface 92 at the inversion position is less than a driving speed after the guide 74 is brought into contact with the contact surface 92.

In the present embodiment, a distance between the inversion position and the discharge position is known, and the driving speed of the driving motor 45 is set to a low speed within a range in which the guide 74 moves by the distance.

(Blocking Mechanism 99)

The blocking mechanism 99 illustrated in FIGS. 5 and 9 is an example of a blocking unit, and blocks the transmission of the driving force of the driving motor 45 to the guide 74. Specifically, the blocking mechanism 99 includes a torque limiter and blocks the transmission of the driving force of the driving motor 45 to the guide 74 when a moving load greater than or equal to a predetermined load acts on the guide 74 moving in the first moving direction. Accordingly, as described above, even though the driving force is output from the driving motor 45 after the guide 74 comes into contact with the contact surface 91, a moving load exceeding the predetermined load is prevented from acting on the guide 74.

Even when the guide 74 moves in the second moving direction, the blocking mechanism 99 blocks the transmission of the driving force of the driving motor 45 to the guide 74 when the moving load greater than or equal to the predetermined load acts on the guide 74. Accordingly, as described above, even though the driving force is output from the driving motor 45 after the guide 74 comes into contact the contact surface 92, the moving load exceeding the predetermined load is prevented from acting on the guide 74. As described above, in the present embodiment, the blocking mechanism 99 functions as an example of a first blocking unit and a second blocking unit.

(Opening and Closing Bodies 81 and 82)

The opening and closing bodies 81 and 82 are examples of an opening and closing unit, and are supported by the support frames 47 and 48 so as to be openable and closable. The opening and closing bodies 81 and 82 are opened and closed by moving relative to the support frames 47 and 48 including the driving rollers 41A and 42A, the driving motor 45, and the guide 74.

Specifically, the opening and closing bodies 81 and 82 are opened and closed between an opened position illustrated in FIG. 2 and a closed position illustrated in FIG. 10 by integrally rotating the other end side (specifically, a left end side of the opening and closing body 82) with one end side (specifically, a right end side) as a support point. In FIGS. 2, 6, and 10, rotary shafts (support points) of the opening and closing bodies 81 and 82 are indicated by a reference 82S.

The opening and closing bodies 81 and 82 have a function of guiding the recording medium P. The opening and closing body 81 is disposed on a left side of the driving roller 41A. The opening and closing body 81 includes a guide surface 81A facing the guide 71 and a guide surface 81B facing the opening and closing body 82 (an obliquely upper left side in FIG. 2). At the opening and closing body 81, the recording medium P comes into contact with the guide surface 81A, and thus, the recording medium P is guided toward the downstream side in the conveyance direction (specifically, toward the contact region 41S of the driving roller 41A). At the opening and closing body 81, the recording medium P comes into contact with the guide surface 81B, and thus, the recording medium P is guided toward the downstream side in the conveyance direction (specifically, toward the contact region 43S of the driving roller 43A).

As described above, the driven roller 41B is rotatably supported by the opening and closing body 81, and the driven roller 41B moves together with the opening and closing body 81.

The opening and closing body 82 is disposed on an upper side of the opening and closing body 81, the guide 74, and the driving roller 42A. The opening and closing body 82 includes a guide surface 82A facing the guide surface 81B of the opening and closing body 81. At the opening and closing body 82, the recording medium P comes into contact with the guide surface 82A, and thus, the recording medium P is guided toward the downstream side in the conveyance direction (specifically, toward the contact region 43S of the driving roller 43A). The driven roller 42C is rotatably supported at one end portion (specifically, a right end side) of the opening and closing body 82, and the driven roller 42C moves together with the opening and closing body 82. The driving roller 43A and the driven roller 43B are rotatably supported at the other end portion (specifically, a left end portion) of the opening and closing body 82, and the driving roller 43A and the driven roller 43B move together with the opening and closing body 82.

For example, when the recording medium P is jammed in the discharge path (see the arrows A1 and A2 in FIG. 2) and the inversion path (see the arrows B1, B2, and B3 in FIG. 6), the opening and closing bodies 81 and 82 are opened and closed to remove the jammed recording medium P. The opening and closing bodies 81 and 82 are opened and closed, for example, in a state where an exterior cover (not illustrated) that is provided on the image forming apparatus body 11 to cover the opening and closing bodies 81 and 82 is opened.

(Action According to Present Embodiment)

In the present embodiment, the driving motor 45 drives the conveyance unit 49 and the guide 74. The contact surface 91 comes into contact with the guide 74 moving to the discharge position from the inversion position in the first moving direction by the driving force of the driving motor 45 to restrict the movement of the guide 74 in the first moving direction. When the moving load greater than or equal to the predetermined load acts on the guide 74 moving in the first moving direction, the blocking mechanism 99 blocks the transmission of the driving force of the driving motor 45 to the guide 74.

As described above, since the driving motor 45 drives the conveyance unit 49 and the guide 74, increases in sizes of the second conveyance device 40 and the image forming apparatus 10 are suppressed as compared with a case where the driving motor 45 includes a driving unit that moves the guide 74 is provided separately from the driving unit that drives the conveyance unit 49.

In the present embodiment, the driving speed of the driving motor 45 until the guide 74 positioned at the inversion position is brought into contact with the contact surface 91 at the discharge position is less than the driving speed after the guide 74 is brought into contact with the contact surface 91.

Thus, as compared with a case where the driving speed of the driving motor 45 until the guide 74 positioned at the inversion position is brought into contact with the contact surface 91 at the discharge position is set to be greater than or equal to the driving speed after the guide 74 is brought into contact with the contact surface 91, a contact sound generated when the guide 74 comes into contact with the contact surface 91 is reduced.

In the present embodiment, the driving motor 45 drives the guide 74 to move in the second moving direction from the discharge position to the inversion position. The contact surface 92 comes into contact with, at the inversion position, the guide 74 moving to the inversion position from the discharge position in the second moving direction by the driving force of the driving motor 45 to restrict the movement of the guide 74 in the second moving direction. When the moving load greater than or equal to the predetermined load acts on the guide 74 moving in the second moving direction, the blocking mechanism 99 blocks the transmission of the driving force of the driving motor 45 to the guide 74.

As described above, even when the guide 74 is moved in the second moving direction, since the driving motor 45 drives the guide 74, upsizing of the second conveyance device 40 and the image forming apparatus 10 are suppressed as compared with a case where a driving unit that moves the guide 74 in the second moving direction is provided separately from the driving unit that drives the conveyance unit 49.

In the present embodiment, the driving speed of the driving motor 45 until the guide 74 positioned at the discharge position is brought into contact with the contact surface 92 at the inversion position is less than the driving speed after the guide 74 is brought into contact with the contact surface 92.

Thus, as compared with a case where the driving speed of the driving motor 45 until the guide 74 positioned at the discharge position is brought into contact with the contact surface 92 at the inversion position is set to be greater than or equal to the driving speed after the guide 74 is brought into contact with the contact surface 92, a contact sound when the guide 74 comes into contact with the contact surface 92 is reduced.

In the present embodiment, as illustrated in FIG. 2, the guide 74 is disposed between the driving roller 41A and the driving roller 42A.

Thus, upsizing of the second conveyance device 40 and the image forming apparatus 10 are suppressed as compared with a case where the guide 74 is disposed at a position outside a gap between the driving roller 41A and the driving roller 42A.

In the present embodiment, the transmission mechanism 50 that transmits the driving force of the driving motor 45 to the driving rollers 41A and 42A transmits the driving force of the driving motor 45 to the guide 74.

Thus, upsizing of the second conveyance device 40 and the image forming apparatus 10 are suppressed as compared with a case where a transmission mechanism different from the transmission mechanism 50 that transmits the driving force of the driving motor 45 to the driving rollers 41A and 42A transmits the driving force of the driving motor 45 to the guide 74.

In the present embodiment, the opening and closing bodies 81 and 82 are opened and closed by moving relative to the support frames 47 and 48 including the driving rollers 41A and 42A, the driving motor 45, and the guide 74.

Thus, a positional relationship among the driving rollers 41A and 42A, the driving motor 45, and the guide 74 are prevented from being changed as compared with a case where the driving rollers 41A and 42A, the driving motor 45, and a part of the guide 74 move relative to the support frames 47 and 48 together with the opening and closing bodies 81 and 82.

(Modification of Image Forming Unit 14)

In the present embodiment, although the image forming unit 14 employing an intermediate transfer system is used as an example of the image forming unit, the present invention is not limited thereto. For example, a direct transfer system in which each of the toner image forming units 20Y to 20K directly forms the toner image on the recording medium P without using the transfer body 24 may be used as an example of the image forming unit. As an example of the image forming unit, an image forming unit that ejects ink onto the recording medium P to form an image may be used, and any image forming unit may be used as long as the image forming unit has a function of forming an image on the recording medium P.

(Modification of Second Conveyance Device 40)

In the present embodiment, although the second conveyance device 40 is provided, as an example of the conveyance device, in the image forming apparatus 10, the present invention is not limited thereto. As an example of the conveyance device, a device having functions (for example, reading, heating, and cutting of an image) other than the function of forming the image may be provided, or the conveyance device may be used alone.

(Modification of Recording Medium P)

In the present embodiment, although the recording medium P is used as an example of the material to be conveyed, the present invention is not limited thereto. For example, as an example of the material to be conveyed, a material that is conveyed for a purpose other than the formation of the material (for example, the reading, heating, and cutting of the image) may be used, or a material that is only conveyed may be used.

(Modification of Conveyance Unit 49)

In the conveyance unit 49, although the driving roller 41A is used as an example of the first conveyance member, the present invention is not limited thereto. A conveyance member such as a conveyance drum or a conveyance belt may be used as an example of the first conveyance member.

In the conveyance unit 49, although the driving roller 42A is used as an example of the second conveyance member, the present invention is not limited thereto. A conveyance member such as a conveyance drum or a conveyance belt may be used as an example of the second conveyance member.

As described above, in place of or in addition to the conveyance roller such as the driving roller, a conveyance member such as a conveyance drum or a conveyance belt, or a constituent unit that conveys the material to be conveyed may be provided as an example of the conveyance unit.

(Modification of Guide 74)

In the present embodiment, although the guide 74 as an example of the guide unit is rotatable between the discharge position and the inversion position, the present invention is not limited thereto. As an example of the guide unit, for example, the guide unit may be slidable (that is, linearly movable) between the discharge position and the inversion position, or may be movable between the discharge position and the inversion position.

In the present embodiment, although the guide 74 as an example of the guide unit is rotatable between the discharge position at which the discharge path is formed (the position indicated by the solid line in FIG. 2) and the inversion position at which the inversion path is formed (the position indicated by the dashed double-dotted line in FIG. 2), the present invention is not limited thereto. As an example of the guide unit, for example, the guide unit may move to the first discharge position at which the first discharge path is formed and the second discharge position at which the second discharge path is formed, or may move to the position at which a conveyance path other than the discharge path and the inversion path is formed.

(Modification of Driving Motor 45)

In the present embodiment, although a stepping motor is used as the driving motor 45 as an example of the driving unit, the present invention is not limited thereto. As an example of the driving motor 45, for example, a DC motor (that is, a direct current motor) may be used, and any driving unit that drives the conveyance unit 49 and the guide 74 may be used.

(Modification of Contact Surfaces 91 and 92)

In the present embodiment, although the contact surfaces 91 and 92 as examples of the first restriction unit and the second restriction unit are formed on the support frames 47 and 48, the present invention is not limited thereto. As examples of the first restriction unit and the second restriction unit, for example, members (for example, a projection and the like) provided on the support frames 47 and 48 may be used, and members coming into contact with the guide 74 to restrict the movement of the guide 74 may be used.

(Modification of Blocking Mechanism 99)

In the present embodiment, although the blocking mechanism 99 as an example of the blocking unit includes a torque limiter, the present invention is not limited thereto. As an example of the blocking member, for example, a clutch or the like that can intermittently transmit the driving force from the driving motor 45 may be used, and the transmission of the driving force of the driving motor 45 to the guide 74 may be blocked.

(Modification of Transmission Mechanism 50)

In the present embodiment, although the transmission mechanism 50 transmits the driving force of the driving motor 45 to the driving rollers 41A, 42A, and 43A and the guide 74, the configuration is not limited thereto. For example, the transmission mechanism 50 may transmit the driving force of the driving motor 45 to the driving roller 42A as the conveyance member that rotates forward and backward and the guide 74 as the guide unit and does not to transmit the driving force to at least one of the driving rollers 41A, 43A, and 42A. That is, at least one of the driving rollers 41A and 43A may receive a driving force from a driving unit different from the driving motor 45. For example, at least one of the driving rollers 41A and 43A may receive a driving force from a driving unit that drives the fixing unit 26.

Even though the driving roller 41A constantly rotates forward as in the present embodiment or the driving roller 41A rotates backward similarly to the driving roller 42A, the recording medium P may be prevented from entering the contact region 41S when the driving roller 41A rotates backward, and thus, the driving roller 41A can be driven by the same driving unit as the driving roller 42A and the guide 74.

The transmission mechanism 50 may transmit the driving force of the driving motor 45 to constituent units other than the driving rollers 41A, 42A, and 43A and the guide 74.

Although a gear 51,52,53,54,55 is used in the transmission mechanism 50, a transmission member such as a pulley or a belt may be used instead of all or a part of the gear gap.

Although the pulleys 61 and 62 and the timing belt 66 are used in the transmission mechanism 50, a transmission member such as a gear may be used instead.

(Modification of Support Frames 47 and 48)

In the present embodiment, although the support frames 47 and 48 as examples of the support body are formed in a shape of a plate of which a thickness direction is to the front-rear direction, the present invention is not limited thereto. For example, the support frames 47 and 48 may be formed in a block shape (for example, a cube or a rectangular parallelepiped) or a box shape, and various shapes can be used as the shapes of the support frames 47 and 48. As an example of the support body, any support body may be used as long as the support body can support the constituent units of the second conveyance device 40 including the driving rollers 41A and 42A, the driving motor 45, and the transmission mechanism 50.

(Modification of Opening and Closing Bodies 81 and 82)

In the present embodiment, although the opening and closing bodies 81 and 82 as examples of the opening and closing unit have the function of guiding the recording medium P and are opened and closed, for example, in order to remove the jammed recording medium P. For example, a cover (that is, a lid) for mainly covering the constituent units of the apparatus may be used as an example of the opening and closing unit, and the opening and closing unit may be opened and closed with respect to the support bodies such as the support frames 47 and 48.

The present invention is not limited to the above-mentioned embodiment, and various modifications, changes, or improvements may be made without departing from the scope of the invention. For example, a plurality of modifications among the above-described modifications may be combined and employed.

EXPLANATION OF REFERENCES

10: Image forming apparatus
11: Image forming apparatus body
12: Accommodation unit
13: First conveyance device
13A: Conveyance member
14: Image forming unit
18: Discharge unit
19: Third conveyance device
19A: Conveyance member
20Y TO 20K: Toner image forming unit
24: Transfer body
26: Fixing unit
40: Second conveyance device (example of conveyance device)
41A: Driving roller (example of first conveyance member)
41B: Driven roller
41S: Contact region
42A: Driving roller (example of second conveyance member)
42B: Driven roller
42C: Driven roller
42S: Contact region
42T: Contact region
43A: Driving roller
43B: Driven roller
43S: Contact region
45: Driving motor (example of driving unit)
47: Support frame (example of support body)
48: Support frame (example of support body)
49: Conveyance unit
50: Transmission mechanism
50A: First transmission path
50B: second transmission path
51: Gear
52: Gear
53: Gear
54: Gear
55: Gear
61: Pulley
62: Pulley
66: Timing belt
71: Guide
71A: Guide surface
72: Guide
72A: Guide surface
74: Guide (example of guide unit)
74A: Guide surface
74B: Guide surface
75: Rotary shaft
76: Projection
81: Opening and closing body (example of opening and closing unit)
81A: Guide surface
81B: Guide surface
82: Opening and closing body (example of opening and closing unit)
82A: Guide surface
90: Restriction mechanism
91: Contact surface (example of restriction unit and first restriction unit)
92: Contact surface (example of restriction unit and second restriction unit)
95: Cutout
99: Blocking mechanism (example of blocking unit, first blocking unit, and second blocking unit)
411: Shaft unit
412: Roller unit
421: Shaft unit
451: Body
452: Driving shaft
521: One-way clutch
611: One-way clutch
P: Recording medium (example of material to be conveyed)

What is claimed is:

1. A conveyance device comprising:

a conveyance unit that conveys a material to be conveyed, wherein the conveyance unit comprises a first conveyance roller;

a guide unit that guides the material to be conveyed, the guide unit being movable between a first position at which a first conveyance path is formed and a second position at which a second conveyance path is formed, wherein the guide unit comprises a guide surface;

a driving motor that drives the conveyance unit and the guide unit;

a first contact surface that comes into contact with the guide unit moving in a first moving direction from the second position to the first position at the first position by a driving force of the driving motor to restrict the movement of the guide unit in the first moving direction; and a blocking unit that blocks transmission of the driving force of the driving motor to the guide unit when a moving load greater than or equal to a predetermined load acts on the guide unit moving in the first moving direction, wherein the blocking unit comprises a torque limiter, wherein the driving motor sets a driving speed until the guide unit positioned at the second position is brought into contact with the first contact surface at the first position to be less than a driving speed after the guide unit is brought into contact with the first contact surface.

2. The conveyance device according to claim 1, further comprising:

a second contact surface that comes into contact with the guide unit moving in a second moving direction from the first position to the second position at the second position by the driving force of the driving motor to restrict the movement of the guide unit in the second moving direction, wherein the blocking unit blocks the transmission of the driving force of the driving motor to the guide unit when the moving load greater than or equal to the predetermined load acts on the guide unit moving in the second moving direction.

3. The conveyance device according to claim 1, wherein the conveyance unit includes the first conveyance roller that is rotationally driven by the driving force of the driving motor, and a second conveyance roller that is disposed on a downstream side of the first conveyance roller in a conveyance direction, and is rotationally driven by the driving force of the driving motor, and the guide unit is disposed between the first conveyance roller and the second conveyance roller.

4. The conveyance device according to claim 3, further comprising:

a transmission mechanism that transmits the driving force of the driving motor to the first conveyance roller and the second conveyance roller, wherein the transmission mechanism transmits the driving force of the driving motor to the guide unit.

5. An image forming apparatus comprising:

an image forming unit that forms an image on a recording medium as the material to be conveyed; and the conveyance device according to claim 1 that conveys the recording medium on which the image is formed by the image forming unit.

6. A conveyance device comprising:

a conveyance unit that conveys a material to be conveyed, wherein the conveyance unit comprises a first conveyance roller;

a guide unit that guides the material to be conveyed, the guide unit being movable between a first position at which a first conveyance path is formed and a second position at which a second conveyance path is formed, wherein the guide unit comprises a guide surface;

a driving motor that drives the conveyance unit and the guide unit;

a first contact surface that comes into contact with the guide unit moving in a first moving direction from the second position to the first position at the first position by a driving force of the driving motor to restrict the movement of the guide unit in the first moving direction;

a second contact surface that comes into contact with the guide unit moving in a second moving direction from the first position to the second position at the second position by the driving force of the driving motor to restrict the movement of the guide unit in the second moving direction; and a blocking unit that comprises a torque limiter, wherein the blocking unit blocks transmission of the driving force of the driving motor to the guide unit when a moving load greater than or equal to a predetermined load acts on the guide unit moving in the first moving direction, wherein the blocking unit blocks the transmission of the driving force of the driving motor to the guide unit when the moving load greater than or equal to the predetermined load acts on the guide unit moving in the second moving direction, wherein the driving motor sets a driving speed until the guide unit positioned at the first position is brought into contact with the second contact surface at the second position to be less than a driving speed after the guide unit is brought into contact with the second contact surface.

7. A conveyance device comprising:

a conveyance unit that conveys a material to be conveyed;

a guide unit that guides the material to be conveyed, the guide unit being movable between a first position at which a first conveyance path is formed and a second position at which a second conveyance path is formed, wherein the guide unit comprises a guide surface;

a driving motor that drives the conveyance unit and the guide unit;

a first contact surface that comes into contact with the guide unit moving in a first moving direction from the second position to the first position at the first position by a driving force of the driving motor to restrict the movement of the guide unit in the first moving direction; and a blocking unit that blocks transmission of the driving force of the driving motor to the guide unit when a moving load greater than or equal to a predetermined load acts on the guide unit moving in the first moving direction, wherein the blocking unit comprises a torque limiter, wherein the conveyance unit includes a first conveyance roller that is rotationally driven by the driving force of the driving motor, and a second conveyance roller that is disposed on a downstream side of the first conveyance roller in a conveyance direction, and is rotationally driven by the driving force of the driving motor, and the guide unit is disposed between the first conveyance roller and the second conveyance roller, wherein the conveyance device further comprises:

a support body that supports the first conveyance roller, the second conveyance roller, the driving motor, and the guide unit; and an opening and closing unit that moves relative to the support body including the first conveyance roller, the second conveyance roller, the driving motor, and the guide unit to open the first conveyance path, wherein the opening and closing unit comprises a guide surface.

* * * * *